US005947068A

United States Patent [19]

Araki

[11] Patent Number: 5,947,068

[45] Date of Patent: Sep. 7, 1999

[54] FOUR-STROKE CYCLE INTERNAL COMBUSTION ENGINE

[75] Inventor: Tsuneo Araki, Hinode-machi, Japan

[73] Assignee: Kioritz Corporation, Tokyo, Japan

[21] Appl. No.: 09/164,369

[22] Filed: Oct. 1, 1998

[30] Foreign Application Priority Data

Oct. 3, 1997 [JP] Japan ..... 9-271060

[51] Int. Cl.[6] ..... F01M 1/00; F01M 3/00

[52] U.S. Cl. ..... 123/90.31; 123/90.34; 123/41.86; 123/572

[58] Field of Search ..... 123/90.27, 90.31, 123/90.33, 90.34, 41.86, 572

[56] References Cited

U.S. PATENT DOCUMENTS

| | | | |
|---|---|---|---|
| 4,651,704 | 3/1987 | Sekiguchi | 123/572 |
| 4,840,149 | 6/1989 | Fujita | 123/90.31 |
| 4,974,561 | 12/1990 | Murasaki et al. | 123/90.34 |
| 5,111,782 | 5/1992 | Mezger | 123/90.31 |
| 5,243,937 | 9/1993 | Imagawa | 123/41.86 |
| 5,690,084 | 11/1997 | Gunji et al. | 123/572 |
| 5,706,769 | 1/1998 | Shimizu | 123/572 |

FOREIGN PATENT DOCUMENTS 0779412 6/1997 European Pat. Off. .

*Primary Examiner*—Weilun Lo

*Attorney, Agent, or Firm*—Thelen Reid & Priest LLP

[57] ABSTRACT

An OHC type four-stroke cycle internal combustion engine comprises a crankshaft, a camshaft, a camshaft bearing for supporting the camshaft, a cam chamber for accommodating the camshaft, a gear train for transmitting the rotation of the crankshaft to the camshaft, a gear chamber for accommodating the gear train, a crankcase communicating with the cam chamber via the gear chamber, an inlet port, and a piston. The camshaft has a camshaft through hole which communicates with the cam chamber at one end and opens toward its circumferential surface supported by the camshaft bearing at the other end. The camshaft bearing has a camshaft bearing through hole which communicates with the camshaft through hole at one end and communicates with the inlet port at the other end. The camshaft through hole and the camshaft bearing through hole communicate with each other by the rotation of the camshaft when the pressure in the crankcase is increasing as a result of a downward movement of the piston thereby communicating the cam chamber with the inlet port, and does not communicate with each other when the pressure in the crankcase is decreasing as a result of an upward movement of the piston thereby shutting off the communication between the cam chamber and the inlet port.

4 Claims, 7 Drawing Sheets

FOUR-STROKE CYCLE INTERNAL COMBUSTION ENGINE

BACKGROUND OF THE INVENTION

The present invention relates to a four-stroke cycle internal combustion engine preferably used for portable working machines, and in particular, to an OHC (over head cam) type four-stroke cycle internal combustion engine equipped with a blow-by gas recirculation device.

DESCRIPTION OF THE PRIOR ART

Recently, there has been an increasing demand for utilizing four-stroke cycle internal combustion engines in portable working machines such as a portable trimmer, a chain saw, or the like, in order to reduce noise and produce cleaner burnt gas exhaustion. For air pollution control, it has been known to return the blow-by gas in the crankcase to the combustion chamber by a blow-by gas recirculation device for combustion.

A portable working machine employing a four-stroke cycle internal combustion engine of the present invention is used in a tilted or sometimes an upside-down position because an operator uses the machine in various positions during operation. In such a case, the lubricating oil in the oil pan may flow toward various engine parts which are normally located above the oil pan.

The object of the present invention is to provide a four-stroke cycle internal combustion engine which is more suitable for mounting on the portable working machines used in different positions and further, which reduces air pollution problems.

SUMMARY OF THE INVENTION

The object of the present invention described above can be achieved by an OHC type four-stroke cycle internal combustion engine comprising: a crankshaft; a camshaft; a camshaft bearing for supporting the camshaft, a cam chamber for accommodating the camshaft; a gear train for transmitting the rotation of the crankshaft to the camshaft; a gear chamber for accommodating the gear train; a crankcase communicating with the cam chamber via the gear chamber; an inlet port, and a piston; the camshaft having a camshaft through hole which communicates with the cam chamber at one end and opens toward its circumferential surface supported by the camshaft bearing at the other end, the camshaft bearing having a camshaft bearing through hole which communicates with the camshaft through hole at one end and communicates with the inlet port at the other end; the camshaft through hole and the camshaft bearing through hole communicate with each other by the rotation of the camshaft when the pressure in the crankcase is increasing as a result of a downward movement of the piston thereby communicating the cam chamber with the inlet port, and does not communicate with each other when the pressure in the crankcase is decreasing as a result of an upward movement of the piston thereby shutting off the communication between the cam chamber and the inlet port.

In the present invention, the rotation of the crankshaft is synchronized with the upward and downward movements of the piston. When the pressure in the crankcase is raised by the downward movement of the piston, the camshaft through hole and the camshaft bearing through hole are positioned to communicate with each other by the rotation of the camshaft and whereby the cam chamber and the inlet port communicate with each other. The blow-by gas in the crankcase is pushed out of the crankcase due to the pressure rise in the crankcase as a result of the downward movement of the piston, and is delivered to the inlet port through the gear chamber, the cam chamber, the camshaft through holes and the camshaft bearing through hole. Further, while the pressure inside the crankcase is reduced by the upward movement of the piston, the camshaft through holes and the camshaft bearing through hole are positioned so as not to communicate with each other. In this way, the communication between the cam chamber and the inlet port is shut off.

According to the present invention, in an OHC type four-stroke cycle internal combustion engine which is constructed to transmit the rotation of the crankshaft to the camshaft via the gear train, a communicating passage which communicates through the crankcase, the gear chamber and the cam chamber, as provided in a conventional structure of the engine can be utilized as an exhaust passage for blow-by gas. Further, utilization of the conventional camshaft, which is rotated synchronously with the movement of the piston, facilitates synchronization of the exhaustion of the blow-by gas with the movement of the piston. Furthermore, no new and complicated mechanism is necessary and therefore, the OHC type four-stroke internal combustion engine can be used without increasing the weight of a portable apparatus on which the engine is mounted. Further since a rotary valve mechanism is provided in a camshaft located at the top of the engine, that is, the farthest location from an oil reserving area located at the bottom of the engine when in an upright position, it can prevent the oil from flowing back therein even when the engine is tilted.

According to an embodiment of the present invention, the camshaft through hole has an inlet hole which opens toward the cam chamber. The inlet hole is surrounded by an oil baffle wall which extends circumferentially around the camshaft at a distance from the inlet hole and rotates with the camshaft to scatter lubricating oil. In this way, the excess oil delivered by the rotation of the gears of the gear train or the oil which flows toward the inlet hole when the four-stroke cycle internal combustion engine is tilted or turned upside-down, is prevented from flowing therein by the oil baffle wall. When the camshaft rotates, the oil reaching the oil baffle wall is kept away from the inlet hole by centrifugal force and thereby the oil is prevented from flowing into the inlet hole.

Further, according to an embodiment of the present invention, an upper space of the cam chamber defines an excess oil reserving area for storing the lubricating oil which flows therein when the engine is turned upside-down, the cam chamber which defines the excess oil reserving area has an upper inner surface, and the inlet hole of the camshaft through hole and the upper inner surface are spaced from each other. Therefore, the upper space of the cam chamber is utilized as the excess oil reservoir, and the oil which flows therein when the four-stroke cycle internal combustion engine is turned upside-down is stored therein. Further, since the inlet hole and the upper inside surface of the cam chamber are spaced from each other by a predetermined distance, the oil which flows into the excess oil reservoir is prevented from flowing into the inlet hole.

DESCRIPTION OF THE PREFERRED EMBODIMENTS

Figure 1:
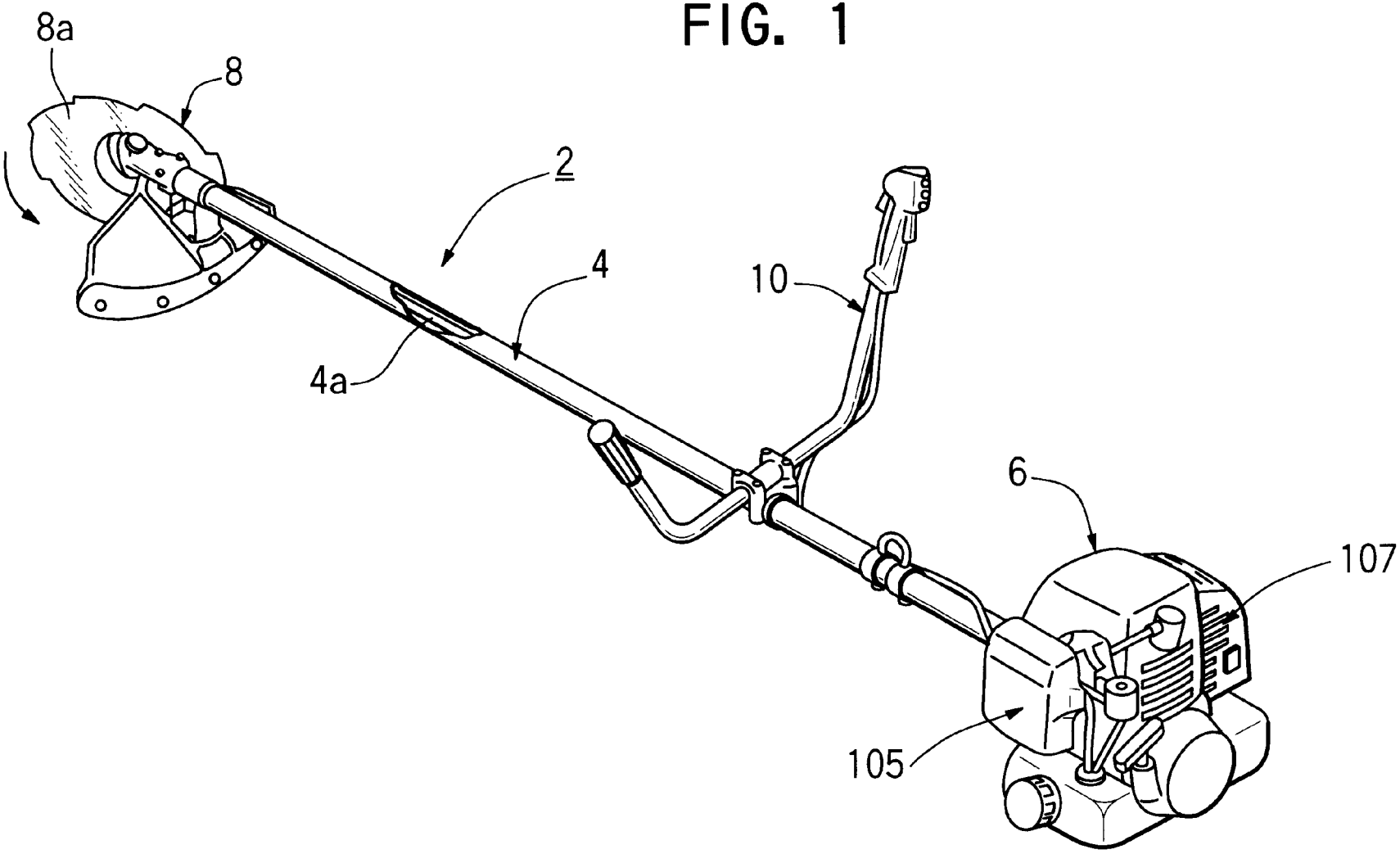
FIG. 1 is an overall perspective view of a portable trimmer.

Referring to the drawings attached herewith, embodiments of the present invention shall be described by explaining a portable trimmer as one example of portable working machines.

As shown in FIG. 1, a portable trimmer 2 includes a supporting tube 4 which has a power transmitting shaft 4*a* inserted therein, a four-stroke cycle internal combustion engine 6 at its rear end, and a working section 8 at its front end. The working section 8 is equipped with a cutting blade 8*a* which rotates to cut weeds in a direction indicated by an arrow. The rotational force from the four-stroke cycle internal combustion engine 6 is transmitted via a centrifugal clutch 110 to the power transmitting shaft 4*a* to rotate the cutting blade 8*a*. An operator holds a handle section 10 provided at the middle portion of the supporting tube 4 by both hands.

Figure 2:
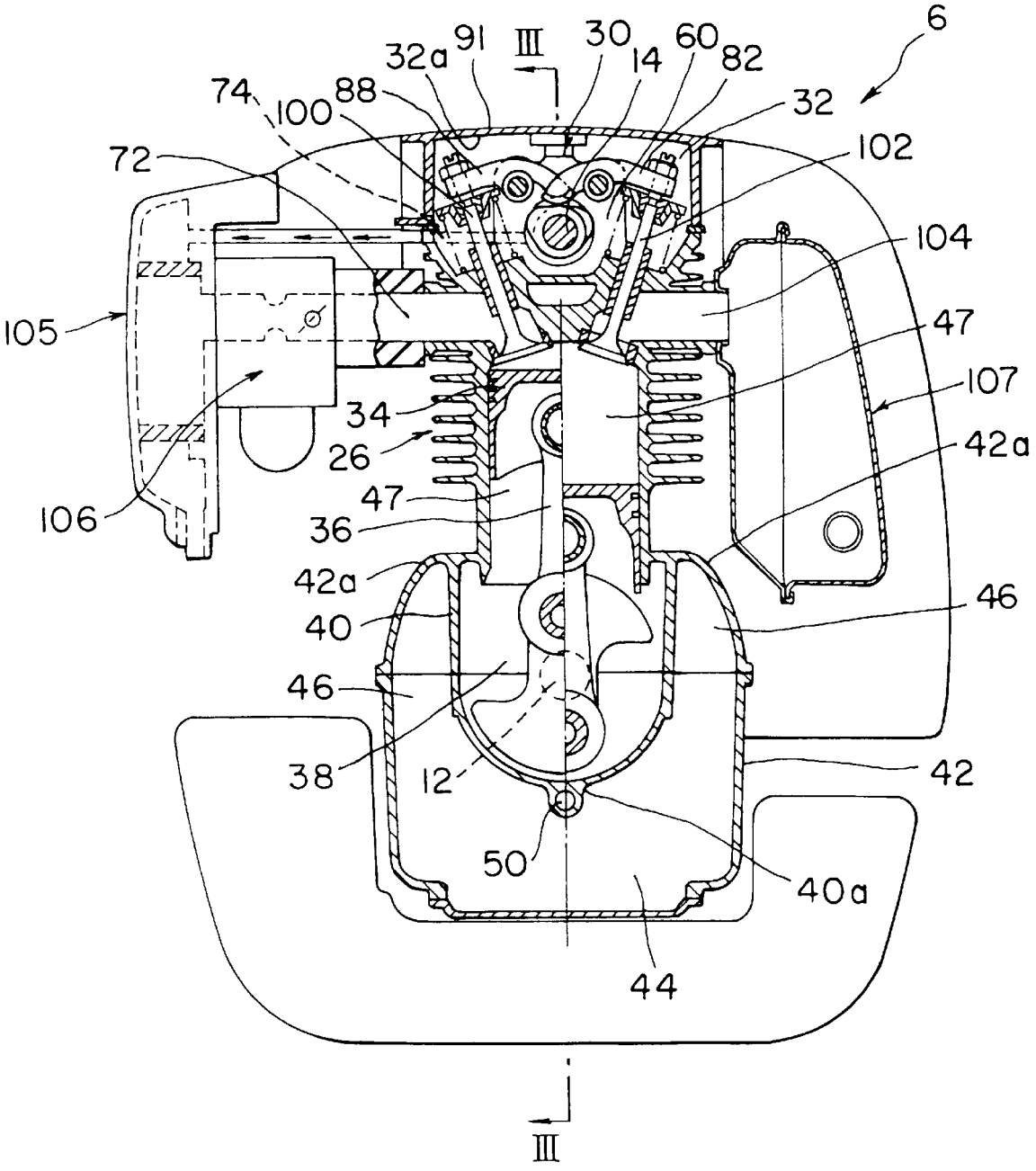
FIG. 2 is a cross-sectional view taken along lines II—II of FIG. 3, illustrating a four-stroke cycle internal combustion engine in accordance with an embodiment of the present invention.
Figure 3:
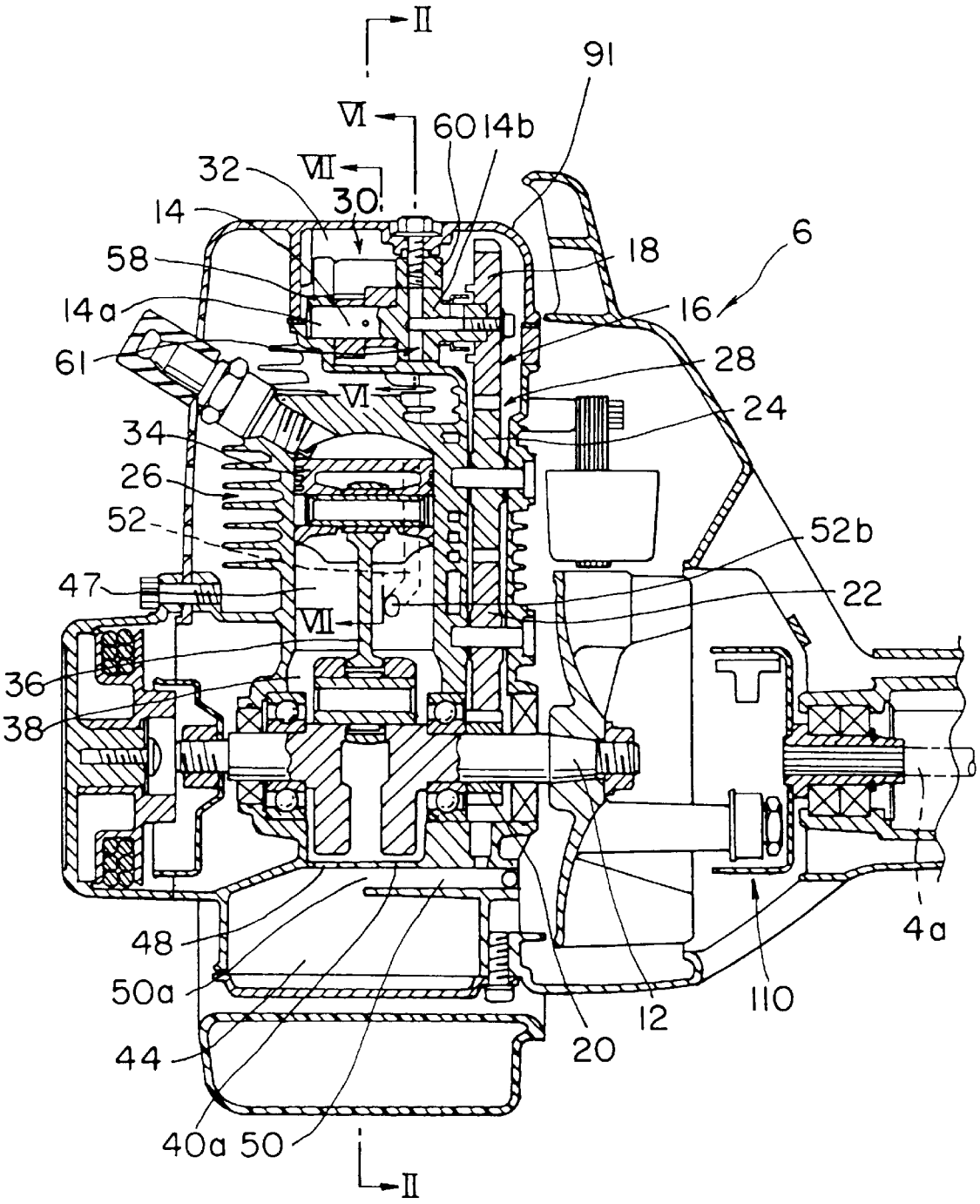
FIG. 3 is a cross-sectional view taken along lines III—III of FIG. 2, illustrating a four-stroke cycle internal combustion engine in accordance with the present embodiment.

The four-stroke cycle internal combustion engine 6 of the present embodiment shown in FIGS. 2 and 3, is of an air-cooled type and of an OHC type. As can be seen in FIG. 3, the rotation of a crankshaft 12 is transmitted to a camshaft 14 through a gear train 16 which includes a cam gear 18 attached to the camshaft 14, a crank gear 20 attached to the crankshaft 12, and two intermediate gears 22, 24 which are intervened between the crank gear 20 and the cam gear 18. The gear train 16 is disposed on the front side of a cylinder block 26 of the four-stroke cycle internal combustion engine 6, that is, the side toward the cutting blade 8*a*. The gear train 16 is disposed vertically along the cylinder block 26 and is accommodated in a gear chamber 28. The gear chamber 28 communicates with a cam chamber 32 to form a communicating space. The cam chamber 32 is defined by a liquid-tight detachable cover 91. A valve drive mechanism 30 which is mounted on an upper part of the cylinder block 26 is accommodated therein. The camshaft 14 is rotated by the gear train 16 which is synchronous with the movement of the crankshaft 12 and makes a half turn for each turn of the crankshaft 12, that is, for each up-and-down stroke of a piston 34.

As shown in FIG. 2, the four-stroke cycle internal combustion engine 6 has an inner wall 40 surrounding a connecting rod 36 on both left and right sides and lower side thereof to form a crankcase 38. An outer wall 42 which surrounds the inner wall 40 with upper ends 42*a* thereof connected to the inner wall 40 so as to form an oil reserving area 44 below the crankcase 38 and oil recess areas 46 on both sides of the crankcase 38. A slit 48 is formed in the inner wall 40 to introduce oil mist from the oil reserving area 44 into a cylinder bore 47 (see FIG. 3). The four-stroke cycle internal combustion engine 6 of the portable trimmer 2 according to the present embodiment is sometimes used in a tilted or upside-down position when an operator uses the cutting blade 8*a* to cut weeds located at a height more than the operator's waist or branches above the operator's head. In such a case, the oil stored in the oil reserving area 44 located below the crankcase 38 flows into the oil recess areas 46, 46 located on both sides of the crankcase 38 to prevent the oil from flowing into the crankcase 38 through the slit 48.

As also can be seen in FIGS. 2 and 3, a horizontal inner wall channel 50 is formed horizontally along the lower surface of a bottom wall portion 40*a* of the inner wall 40. An inlet port 50*a* thereof communicates with the oil reserving area 44 and the other end thereof communicates with the gear chamber 28. Further, as previously described, the gear chamber 28 communicates with the cam chamber 32, and further communicates with the crankcase 38 through a cylinder block vertical channel 52 formed in the cylinder block 26 so that it opens toward the cam chamber 32 at one end and opens toward the crankcase 38 at an outlet port 52*b* at the other end. That is, a communicating passage extends between the oil reserving area 44 and the cylinder bore 47 via the horizontal inside wall channel 50, the gear chamber 28, the cam chamber 32, and the cylinder block vertical channel 52. The oil mist in the oil reserving area 44 is delivered to the gear train 16 and the valve drive mechanism 30 by the pressure change in the crankcase 38 created by the up-and-down stroke of the piston 34 to lubricate them. Oil adhered to the gears 18, 20, 22, 24 is also delivered to the cam chamber 32 by the rotation of the gears in the gear train 16. The excess oil flows back from the cam chamber 32 through the cylinder block vertical channel 52 to the crankcase 38 and returns to the oil reserving area 44 through the slit 48.

Figure 4:
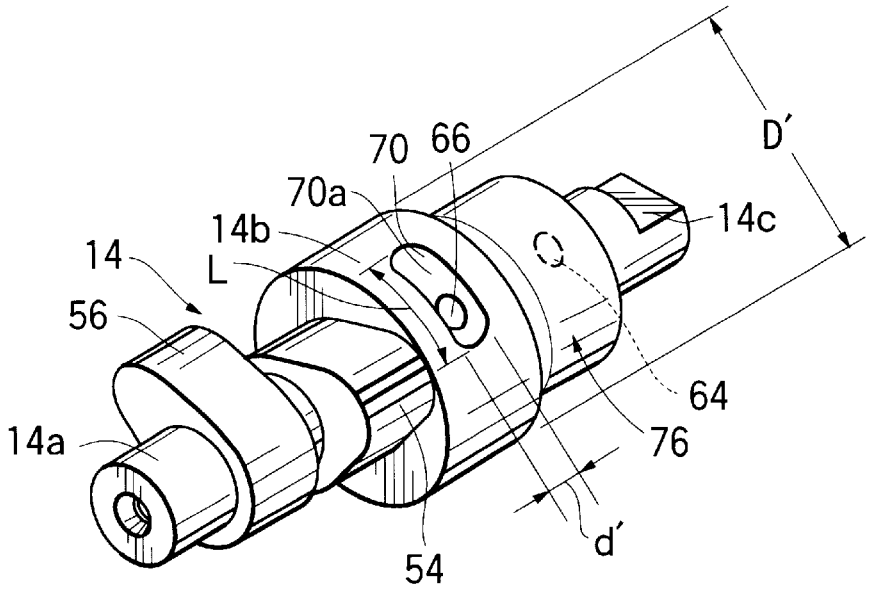
FIG. 4 is a perspective view of a camshaft and cams.
Figure 5:
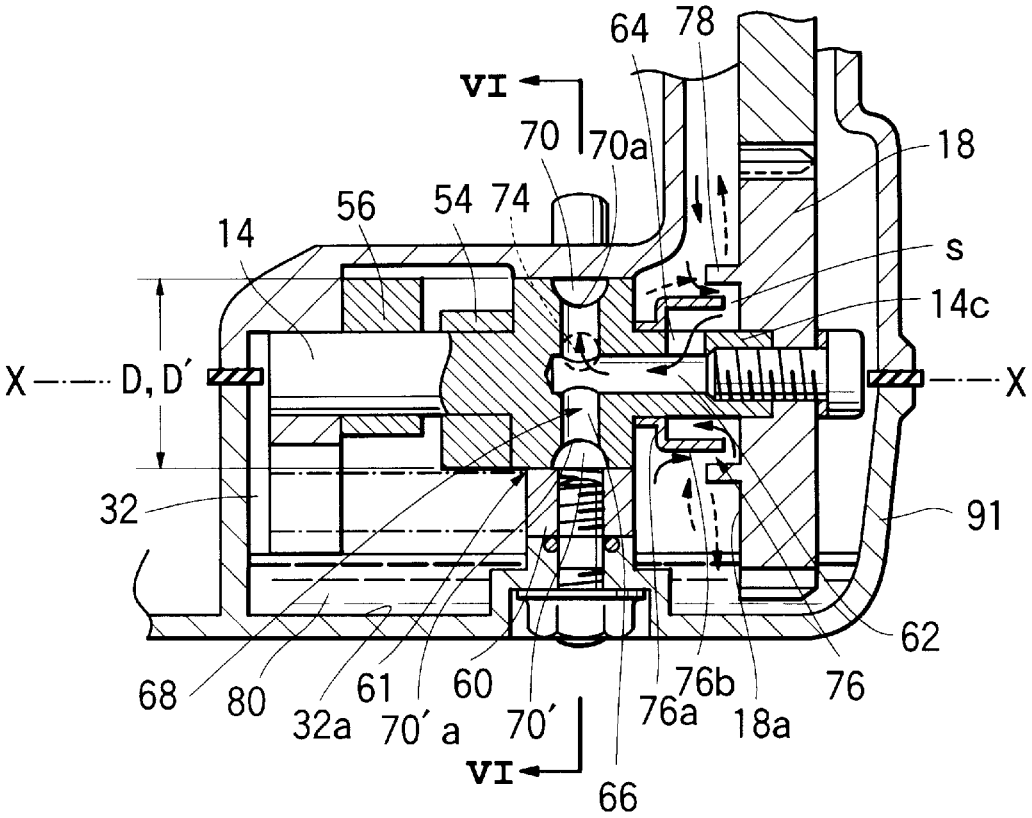
FIG. 5 is a detailed view of a rotary valve mechanism of the present embodiment, illustrating a cam chamber and a camshaft when the four-stroke cycle internal combustion engine shown in FIG. 2 is oriented in an upside-down position by rotation about an axis of a crankshaft.

In this embodiment, a SOHC type valve drive mechanism is employed. As can be seen in FIGS. 4 and 5, the camshaft 14 is provided with an inlet valve cam 54 and an exhaust valve cam 56. Referring to FIG. 3 again, the camshaft 14 is supported by a rear bearing 58 at its rear end portion 14*a* and by an intermediate bearing or a camshaft bearing 60 at its middle portion 14*b*. The bearings are mounted on an upper part of the cylinder block 26. The inner diameter of an intermediate bearing 60 is large enough to allow the inlet valve cam 54 and the exhaust valve cam 56 to pass through and whereby the camshaft 14 having both cams 54, 56 can be installed by laterally insert them into the bearings 58, 60 from the side next to the intermediate bearing 60. The middle part 14*b* of the camshaft 14 supported by the intermediate bearing 60 is formed as a large diameter portion 14*b* having an outer diameter D' which is nearly equal to the inner diameter D of the intermediate bearing 60. The large diameter portion 14*b* is fitted into the intermediate bearing 60 and it rotatably supported thereby. The intermediate bearing 60 and the camshaft 14 constitute a rotary valve 61.

Figure 6:
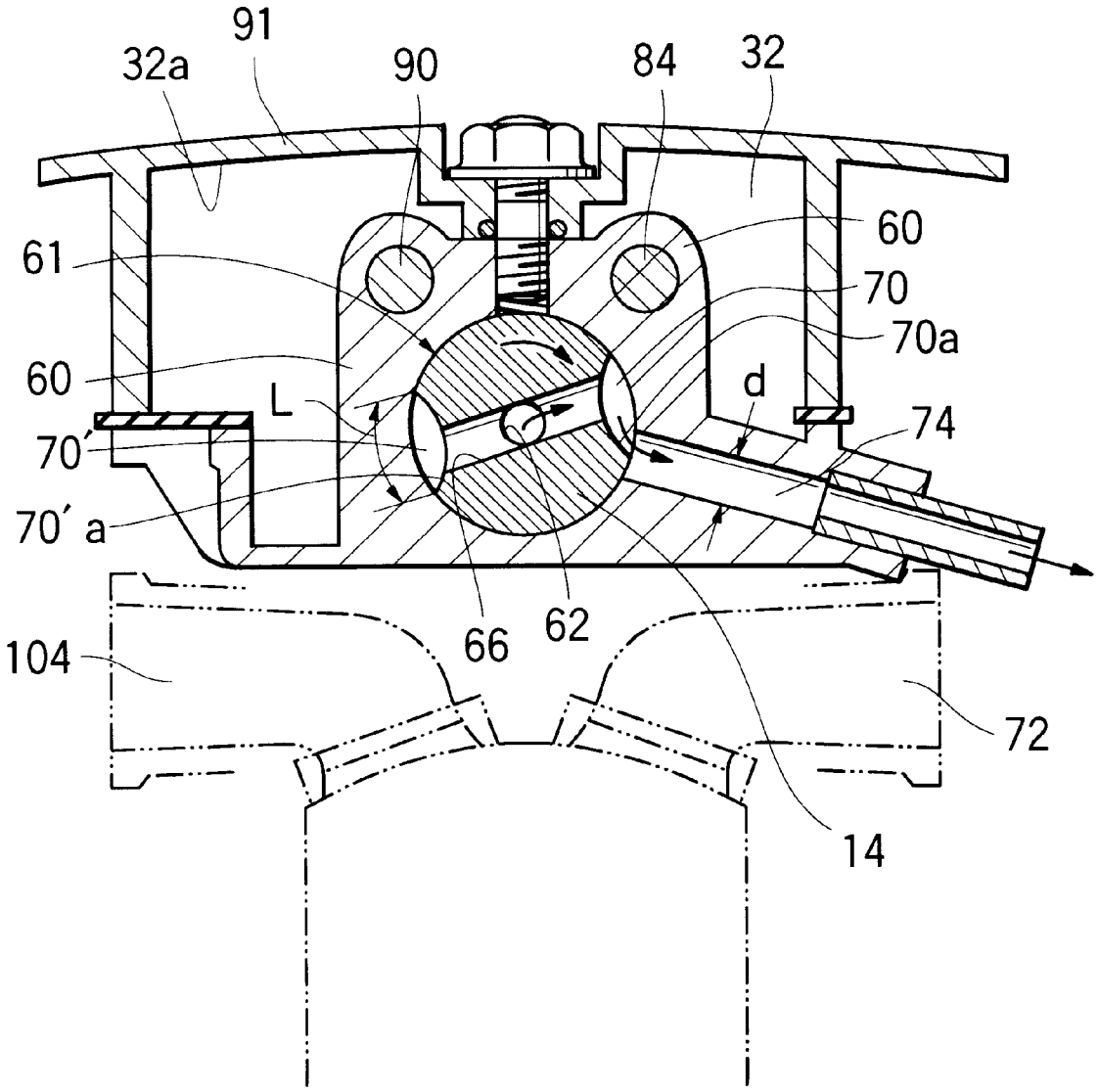
FIG. 6 is a cross-sectional view taken along lines VI—VI of FIGS. 3 and 5, illustrating a large diameter portion of a camshaft.

As shown in FIG. 5, the cam gear 18 is attached to a front end 14*c* of the camshaft 14 located in the cam chamber 32. A horizontal camshaft channel 62 or a camshaft penetrating hole which extends to the large diameter portion 14*b* at the middle of the camshaft 14 along the central axis line X—X thereof is formed at the front end 14*c* of the camshaft 14. The front end of the horizontal camshaft channel 62 toward the cam gear 18 communicates with the cam chamber 32 via a through hole or the camshaft penetrating hole or an inlet hole 64 which extends in the radial direction. A radial channel or the camshaft penetrating hole 66 which penetrates the camshaft 14 in the radial direction is formed in the large diameter portion 14*b* of the camshaft 14. The horizontal camshaft channel 62 intersects with the radial channel 66 to form a T-cross channel 68. As shown in FIGS. 4 and 6, a pair of enlarged recesses or the camshaft penetrating holes 70, 70' which extend in the circumferential direction of the camshaft 14 at both ends of the radial channel 66 of the large diameter portion 14*b*, i.e., 180 degrees apart from each other. As shown in FIG. 6, each of the first and second enlarged recesses 70, 70' are formed in curved surfaces 70*a*, 70*a'* which extend in the circumferential direction of the camshaft 14. Also as shown in FIG. 6, a blow-by gas outlet channel or a camshaft bearing through hole 74 which extends obliquely downward and is in communication with an inlet port 72 through an air cleaner 105 and a carburetor 106, is formed at the intermediate bearing 60 which rotatably supports the large diameter portion 14*b*. The blow-by gas outlet channel 74 has a circular cross-section as shown by a dotted line in FIG. 5. Its inner diameter is nearly equal to a width d' of the first and second enlarged recesses 70, 70' of the camshaft 14. When the camshaft 14 rotates, the blow-by gas outlet channel 74 communicates with either of the first and second enlarged recesses 70, 70' at every half turn of the camshaft 14. They are communicated with each other while the blow-by gas outlet channel 74 moves along an arc length L of the first and second enlarged recess 70 or 70'. The timing when the blow-by gas outlet channel 74 communicates with either of the first and second enlarged recesses 70, 70' is synchronized with the downward movement of the piston 34 as described later. Therefore, it is also synchronized with the valve opening and closing timings of an inlet valve 100 and an exhaust valve 102 which are closed and opened by the two cams 54, 56 mounted on the camshaft 14.

Again referring to FIG. 5, an enclosure wall 76 or an oil baffle wall for covering the through hole 64 formed in the camshaft 14 is integrally mounted on the camshaft 14. The enclosure wall 76 rotates together with the camshaft 14. The enclosure wall 76 includes a ring-shaped side wall portion 76*a* which extends radially outward and circumferentially around the camshaft 14 provided on a far side from the cam gear 18 of the through hole 64, and an annular cover wall portion 76*b* which is connected to the ring side wall portion 76*a* and extends in a axial direction of the camshaft 14 toward the vicinity of the cam gear 18. A narrow gap "s" as a blow-by gas passage is formed between the annular cover wall portion 76*b* and a side surface 18*a* of the cam gear 18. An isolation wall 78 for preventing the oil from directly entering the gap "s" is formed on an inner side surface 18*a* of the cam gear 18 at a distance from the annular cover wall portion 76*b* in a radially outward direction. The isolation wall 78 protrudes parallel with the annular cover wall portion 76*b*. The annular cover wall portion 76*b* and the isolation wall 78 cooperate to form a winding passage. Although the winding passage allows the flow of the blow-by gas as indicated by arrows depicted by the solid line in FIG. 5, it prevents the flow of the oil indicated by arrows depicted by the dotted line even if the four-stroke cycle internal combustion engine 6 is tilted. Further, the enclosure wall 76 rotates with the camshaft 14 to scatter the oil away from the through hole 64 by centrifugal force and thereby preventing the oil from flowing into the through hole 64.

Figure 8:
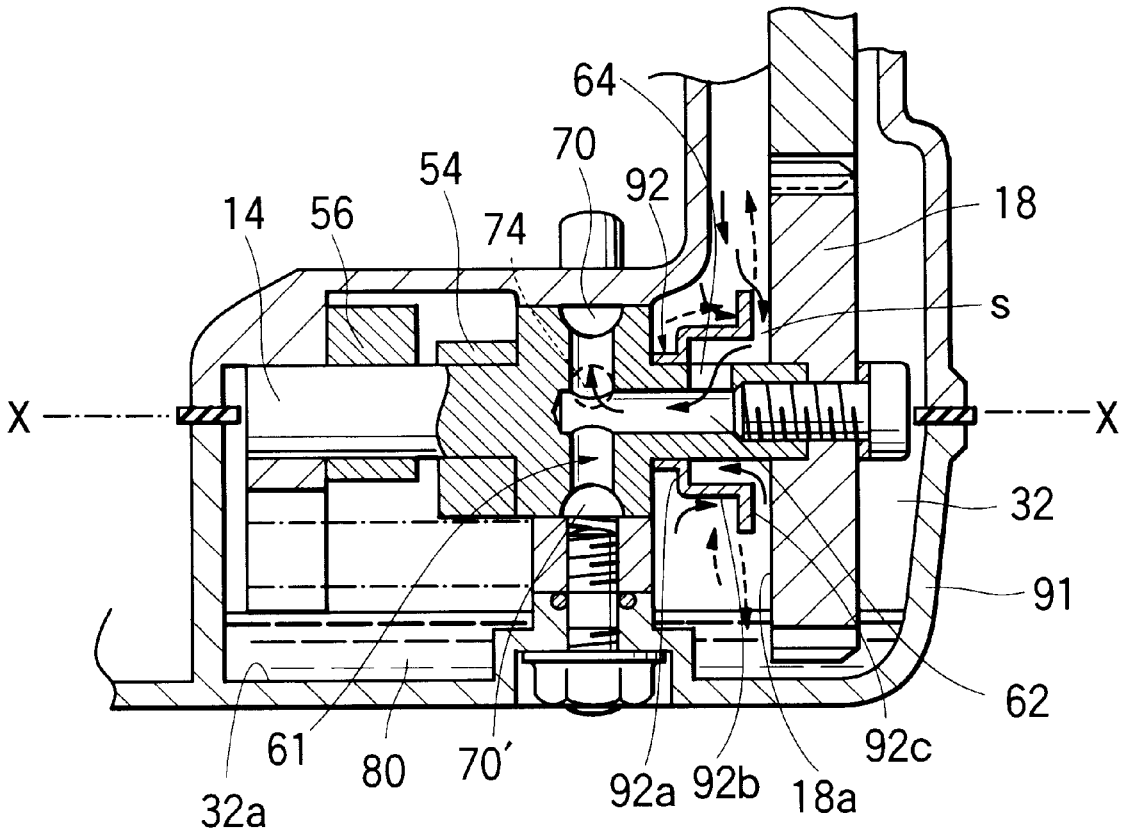
FIG. 8 is a modified embodiment of an enclosure wall.

Further the cam chamber 32 is a liquid-tight closed space separated from the outside. The upper space in the cam chamber 32 in the up-right position is utilized as an excess oil reservoir 80 for storing a small amount of oil which flows thereinto from the oil reservoir 44 via the gear chamber 28 when the 4-cycle internal combustion engine 6 is used in a tilted or upside-down position. FIGS. 5 and 8 illustrate how the excess oil is stored in the excess oil reservoir 80 of the cam chamber 32 when the 4-cycle internal combustion engine 6 is turned upside-down. Since the position of the through hole 64 formed in the camshaft 14 is far enough apart from an upper wall 32*a* of the cam chamber 32 which defines the excess oil reservoir 80, the oil level in the excess oil reservoir 80 does not reach the through hole 64. Therefore, the rotary valve 61 is not clogged up by the excess oil.

Figure 7:
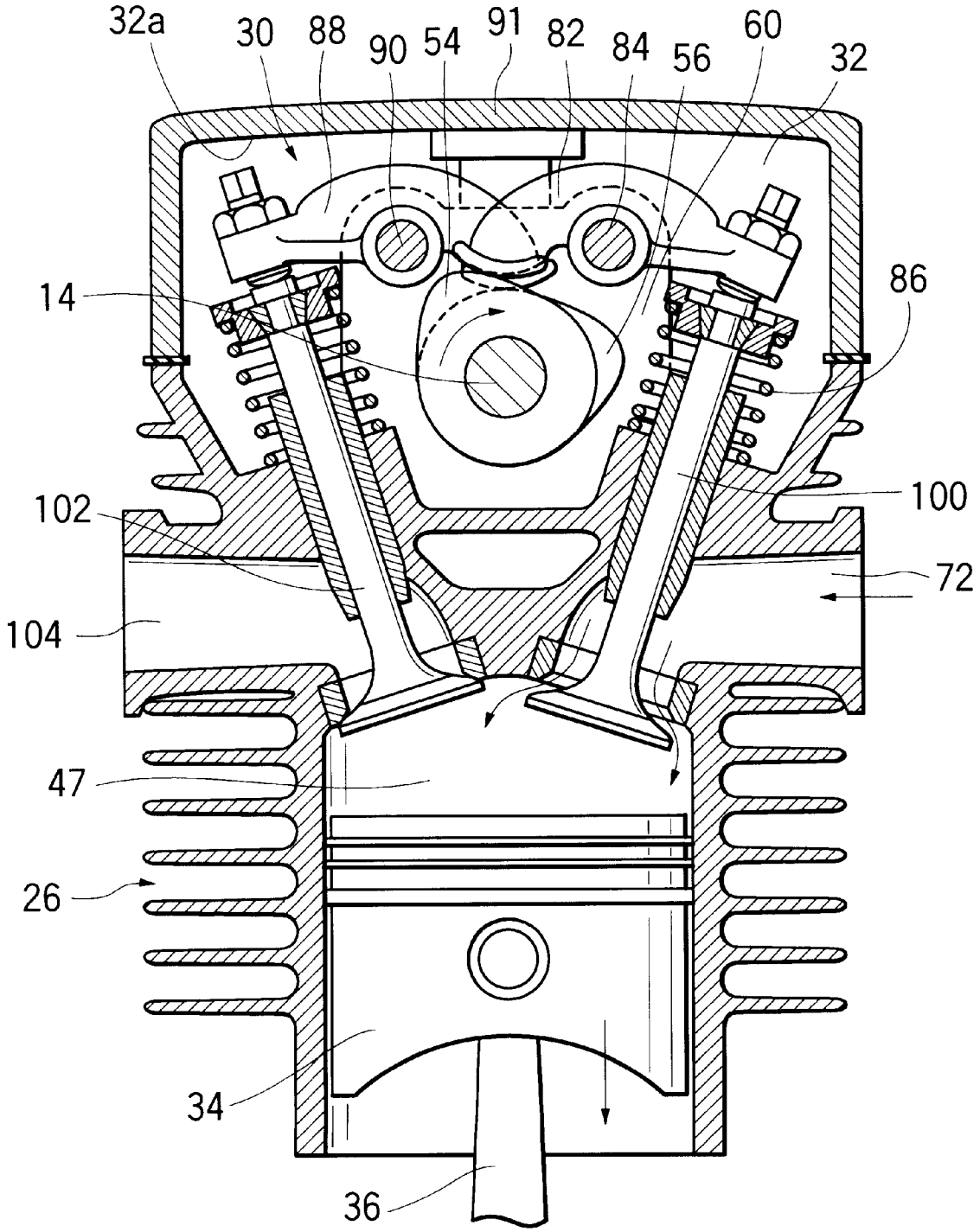
FIG. 7 is an enlarged sectional view taken along lines VII—VII of FIG. 3, illustrating a cylinder bore and a cam chamber of the four-stroke cycle internal combustion engine of FIG. 2.

Referring to FIGS. 5 through 7, the functions of the rotary valve of the present embodiment will hereafter be described.

The camshaft 14 is rotated by the gear train 16 in the direction shown by the arrow in FIG. 6. The inlet valve 100 and the exhaust valve 102 are opened and closed by the inlet valve cam 54 and the exhaust valve cam 56 mounted on the camshaft 14, respectively. In an intake stroke of the 4-cycle internal combustion engine 6, as shown in FIG. 7, a rocker arm 82 for the inlet valve 100 is pushed upwardly by the inlet valve cam 54 and is pivotally rotated about a rocker shaft 84 and whereby the inlet valve 100 is pushed down. The mixture is sucked from the inlet port 72 into the cylinder bore 47 due to a negative pressure created by the downward movement of the piston 34. On the other hand, during this intake stroke, the rotation of the camshaft 14 causes the first enlarged recess 70 to communicate with the blow-by gas outlet channel 74. While the camshaft 14 rotates, i.e., while the first enlarged recess 70 and the blow-by gas outlet channel 74 at least partially align with each other, they communicate with each other to permit the blow-by gas to flow. The blow-by gas which leaked into the crankcase 38 during the previous compression stroke is pushed out of the crankcase 38 due to the pressure rise in the crankcase 38 while the piston 34 is traveling downwardly. It is returned back to the inlet port 72 through the slit 48 of the inside wall 40, the oil reservoir 44, the horizontal inside wall channel 50, the gear chamber 28, the cam chamber 32, further, to the through hole 64 of the camshaft 14, the blow-by gas outlet channel 74, the air cleaner 105 and the carburetor 106. The blow-by gas which returned back to the inlet port 72 is again sucked into the cylinder bore 47 for combustion.

In the subsequent compression stroke, the inlet valve cam 54 further rotates and the inlet valve 100 is closed by the restoring force of a compression spring 86. Some mixture further leaks into the crankcase 38 while the piston 34 travels upwardly. During this compression stroke, the first and second enlarged recesses 70, 70' of the camshaft 14 and the blow-by gas outlet channel 74 are not aligned so that they do not communicate with each other.

In the subsequent explosion stroke, the inlet valve 100 and the exhaust valve 102 are closed. During this stroke, the second enlarged recess 70' of the camshaft 14, which is space at an angle of 180 degrees from the first enlarged recess 70, i.e., located diametrically opposite from the first enlarged recess 70 that communicates with the blow-by gas outlet channel 74 during the intake stroke as described above, takes a position which communicates with the blow-by gas outlet channel 74. Therefore, the blow-by gas is again delivered from the crankcase 38 into the inlet port 72 through the passage as previously described, caused by the pressure rise in the crankcase 38 while the piston 34 travels downwardly in the explosion stroke.

A Further, in the exhaust stroke, a rocker arm 88 for the exhaust valve 102 is pushed upwardly by the exhaust valve cam 56 and pivotally rotates about a rocker shaft 90 whereby the exhaust valve 102 is pushed downwardly. Exhaust gas is pushed out of the exhaust port 104 to an exhaust muffler 107 by the upward movement of the piston 34. During this stroke, the first and second enlarged recesses 70, 70' and the blow-by gas outlet channel 74 are not aligned so that they do not communicate with each other. The same strokes as previously described are repeated.

FIG. 8 illustrates a modified embodiment of an surrounding wall of the present invention.

A surrounding wall or an oil baffle wall 92 in accordance with the present modified embodiment has a ring-shaped side wall portion 92*a*which is located on a far side of the through hole 64 and extends radially outward and circumferentially around the camshaft 14, an annular cover wall portion 92*b* which is connected to the ring side wall portion 92*a* and extends in an axial direction with respect to the camshaft 14 to the vicinity of the cam gear 18, and a flange portion 92*c* which is connected to the annular cover wall portion 92*b* and extends further radially outward and circumferentially around the annular cover wall portion 92*b*. A narrow gap "s" as a blow-by gas passage is formed between the flange portion 92*c* and an inner side surface 18*a* of the cam gear 18. The present modified embodiment does not have the isolation wall 78 provided on the inner side surface 18*a* of the cam gear 18 (refer to FIG. 5). Although the surrounding wall 92 of the present modified embodiment allows the flow of the blow-by gas as indicated by an arrow depicted by the solid line in FIG. 8, it prevents oil from flowing into the through hole 64 as indicated by an arrow depicted by the dotted line. Further, it scatters the oil away from the through hole 64 by the centrifugal force resulting from the rotation of the surrounding wall 92. The flange portion 92*c* prevents the oil from flowing into the through hole 64 in the axial direction of the camshaft 14.

According to the present embodiment, the blow-by gas can be discharged synchronously with the movement of the piston 34 without adding extra weight to the entire device by utilizing the existing camshaft 14 which rotates synchronously with the movement of the piston 34.

Further, the surrounding wall 76 which surrounds the through hole 64 and the isolation wall 78 which is provided to the cam gear 18 extend in different directions to form the winding passage for the blow-by gas. It enables to prevent the flow of the blow-by gas while the flow of the oil is prevented.

The present invention has thus been shown and described with reference to specific embodiments. However, it should be noted that the present invention is in no way limited to the details of the described arrangements but changes and modifications may be made without departing from the scope of the appended claims.

For example, the position and size of the first and second enlarged recesses 70, 70' in the present embodiment described above can be modified by determining the timing and the period for communication with the blow-by gas outlet channel 74 based on the cycle of upward and downward movements of the piston 34 and the valve timing.

I claim:

1. An overhead camshaft (OHC) type four-stroke cycle internal combustion engine comprising:

a crankshaft; a camshaft; a camshaft bearing for supporting said camshaft; a cam chamber for accommodating said camshaft; a gear train for transmitting the rotation of said crankshaft to said camshaft; a gear chamber for accommodating said gear train; a crankcase communicating with said cam chamber via said gear chamber; an inlet port; and a piston;

said camshaft having a camshaft through hole which communicates with said cam chamber at one end and opens toward its circumferential surface supported by said camshaft bearing at the other end, said camshaft bearing having a camshaft bearing through hole which communicates with said camshaft through hole at one end and communicates with said inlet port at the other end; and said camshaft through hole and said camshaft bearing through hole communicate with each other by the rotation of said camshaft when the pressure in said crankcase is increasing as a result of a downward movement of said piston thereby communicating said cam chamber with said inlet port, and does not communicate with each other when the pressure in said crankcase is decreasing as a result of an upward movement of said piston thereby shutting off the communication between said cam chamber and said inlet port.

2. An OHC type four-stroke cycle internal combustion engine in accordance with claim 1, wherein said camshaft through hole has an inlet hole which opens toward said cam chamber, said inlet hole is surrounded by an oil baffle wall which extends circumferentially around said camshaft at a distance from said inlet hole and rotates with said camshaft to scatter lubricating oil.

3. An OHC type four-stroke cycle internal combustion engine in accordance with claim 1, wherein an upper space of said cam chamber defines an excess oil reserving area for storing the lubricating oil which flows therein when said engine is turned upside-down, said cam chamber which defines said excess oil reserving area has an upper inner surface; and said camshaft through hole has an inlet hole, said inlet hole and said upper inner surface being spaced from each other.

4. An OHC type four-stroke cycle internal combustion engine in accordance with claim 2, wherein an upper space of said cam chamber defines an excess oil reserving area for storing the lubricating oil which flows therein when said engine is turned upside-down, said cam chamber which defines said excess oil reserving area has an upper inner surface; and said inlet hole of said camshaft through hole and said upper inner surface are spaced from each other.

* * * * *